US008319413B2

(12) United States Patent
Wei et al.

(10) Patent No.: US 8,319,413 B2
(45) **Date of Patent: *Nov. 27, 2012**

(54) COLOR FIELD EMISSION DISPLAY HAVING CARBON NANOTUBES

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/950,001

(22) Filed: Nov. 19, 2010

(65) Prior Publication Data

US 2011/0062856 A1 Mar. 17, 2011

Related U.S. Application Data

(63) Continuation of application No. 12/069,300, filed on Feb. 8, 2008, now Pat. No. 7,863,806.

(30) Foreign Application Priority Data

Nov. 23, 2007 (CN) ..... 2007 1 0124774

(51) Int. Cl.
*H01J 1/62* (2006.01)

(52) U.S. Cl. ..... 313/495; 313/496; 313/497; 313/498; 313/309

(58) Field of Classification Search ..... 313/495–498, 313/309–310
See application file for complete search history.

(56) References Cited

U.S. PATENT DOCUMENTS

| | | | | |
|---|---|---|---|---|
| 6,794,814 | B2 | 9/2004 | Lee et al. | |
| 6,821,175 | B1 | 11/2004 | Tuck et al. | |
| 7,208,866 | B2 | 4/2007 | Chiou et al. | |
| 7,781,954 | B2 * | 8/2010 | Wei et al. | 313/495 |
| 7,821,193 | B2 * | 10/2010 | Wei et al. | 313/496 |
| 2003/0090190 | A1 | 5/2003 | Takai et al. | |
| 2003/0102222 | A1 | 6/2003 | Zhou et al. | |
| 2004/0047038 | A1 * | 3/2004 | Jiang et al. | 359/486 |
| 2004/0095050 | A1 * | 5/2004 | Liu et al. | 313/309 |
| 2006/0066216 | A1 | 3/2006 | Koga et al. | |
| 2006/0132048 | A1 | 6/2006 | Popovich | |

(Continued)

FOREIGN PATENT DOCUMENTS

| | | |
|---|---|---|
| TW | 304256 | 5/1997 |

(Continued)

OTHER PUBLICATIONS

Wei et al, Vacuum Breakdown Induced Needle Shaped End of Multiwalled Carbon Nanotubes and Their Field Application, Nano Letters, Nov. 16, 2007, and vol. 7, No. 12, pp. 3792-3797.*

*Primary Examiner* — Tracie Y Green
(74) *Attorney, Agent, or Firm* — Altis Law Group, Inc.

(57) ABSTRACT

A color field emission display includes a sealed container and a color element enclosed in the sealed container. The color element includes a cathode, an anode, a phosphor layer and a carbon nanotube string. The anode is located spaced from the cathode. The phosphor layer is formed on an end surface of the anode. The carbon nanotube string has a first end electrically connected to the cathode and an opposite second end functioning as an emission portion. The second end includes a plurality of tapered carbon nanotube bundles.

20 Claims, 5 Drawing Sheets

U.S. PATENT DOCUMENTS

| | | | | |
|---|---|---|---|---|
| 2007/0251815 | A1 | 11/2007 | Lo et al. | |
| 2008/0018228 | A1 * | 1/2008 | Choi et al. | 313/497 |

FOREIGN PATENT DOCUMENTS

| | | |
|---|---|---|
| TW | 373216 | 11/1999 |
| TW | 445477 | 7/2001 |
| TW | 483016 | 4/2002 |
| TW | 518627 | 1/2003 |
| TW | I224352 | 11/2004 |
| TW | 200739650 | 10/2007 |
| WO | WO0221492 | 3/2002 |

* cited by examiner

COLOR FIELD EMISSION DISPLAY HAVING CARBON NANOTUBES

RELATED APPLICATIONS

This application is a continuation application of U.S. patent application Ser. No. 12/069,300, filed Feb. 8, 2008, entitled, "COLOR FIELD EMISSION DISPLAY HAVING CARBON NANOTUBES".

BACKGROUND

1. Field of the Invention

The invention relates to color field emission displays and, particularly, to a color field emission display having carbon nanotubes.

2. Discussion of Related Art

Field emission displays (FEDs) are based on emission of electrons in vacuum. Electrons are emitted from micron-sized tips in a strong electric field, and the electrons are accelerated and collide with a fluorescent material, and then the fluorescent material emits visible light. FEDs are thin, light weight, and provide high levels of brightness.

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for electron emitter in FED. Generally, a color FED of the FED includes a number of CNTs acting as electron emitters. However, single CNT is so tiny in size and then the controllability of the method manufacturing is less than desired. Further, the luminous efficiency of the FED is low due to the shield effect caused by the adjacent CNTs.

What is needed, therefore, is a color FED, which has high luminous efficiency and can be easily manufactured.

BRIEF DESCRIPTION OF THE DRAWINGS

Many aspects of the present color FED can be better understood with reference to the following drawings. The components in the drawings are not necessarily to scale, the emphasis instead being placed upon clearly illustrating the principles of the present color FED.

Figure 1:
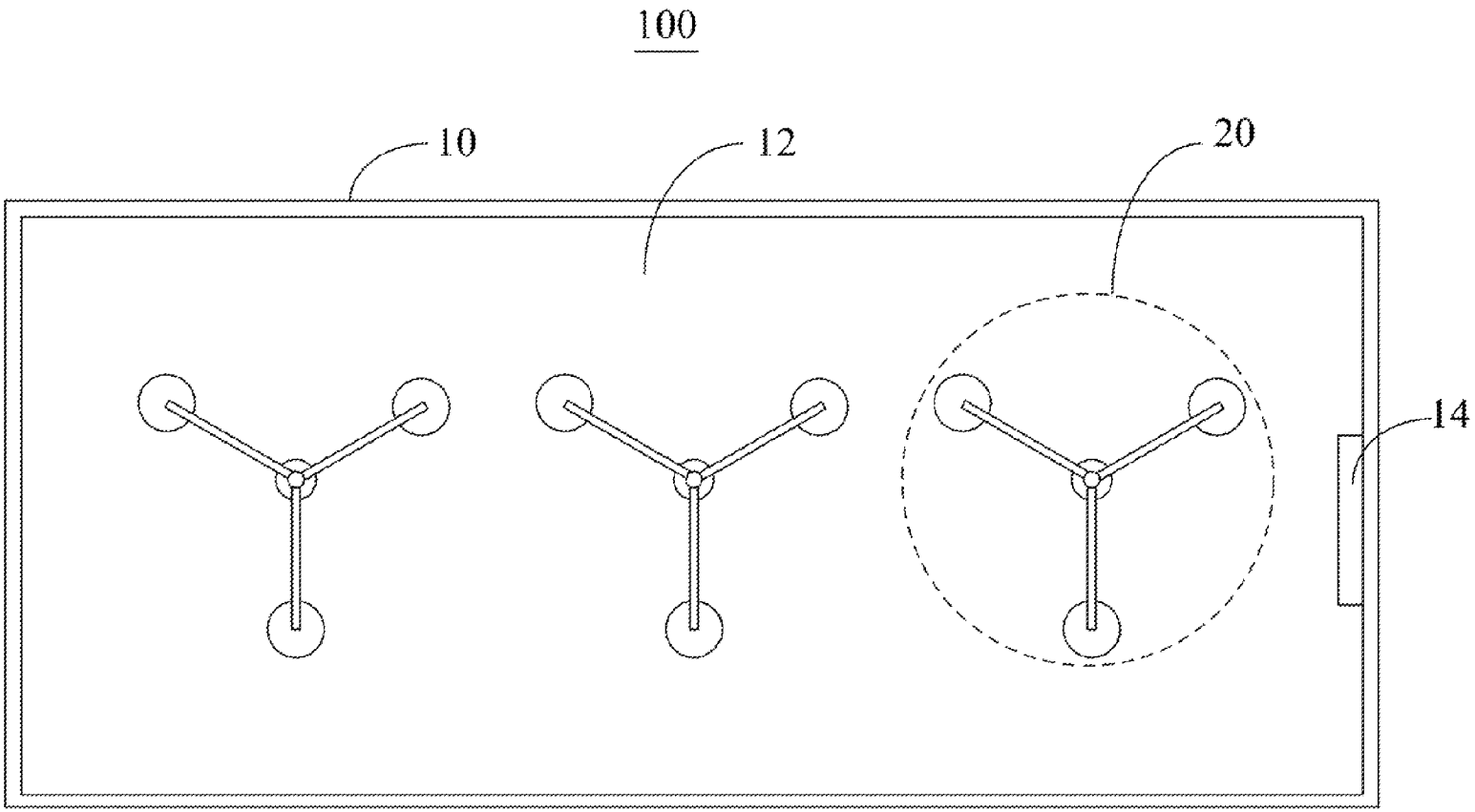
FIG. 1 is a schematic, top-sectional view of a color FED according to an embodiment.

Corresponding reference characters indicate corresponding parts throughout the several views. The exemplifications set out herein illustrate at least one preferred embodiment of the color FED, in one form, and such exemplifications are not to be construed as limiting the scope of the invention in any manner.

DETAILED DESCRIPTION OF PREFERRED EMBODIMENTS

Reference will now be made to the drawings to describe the preferred embodiments of the present color FED having carbon nanotubes, in detail.

Figure 2:
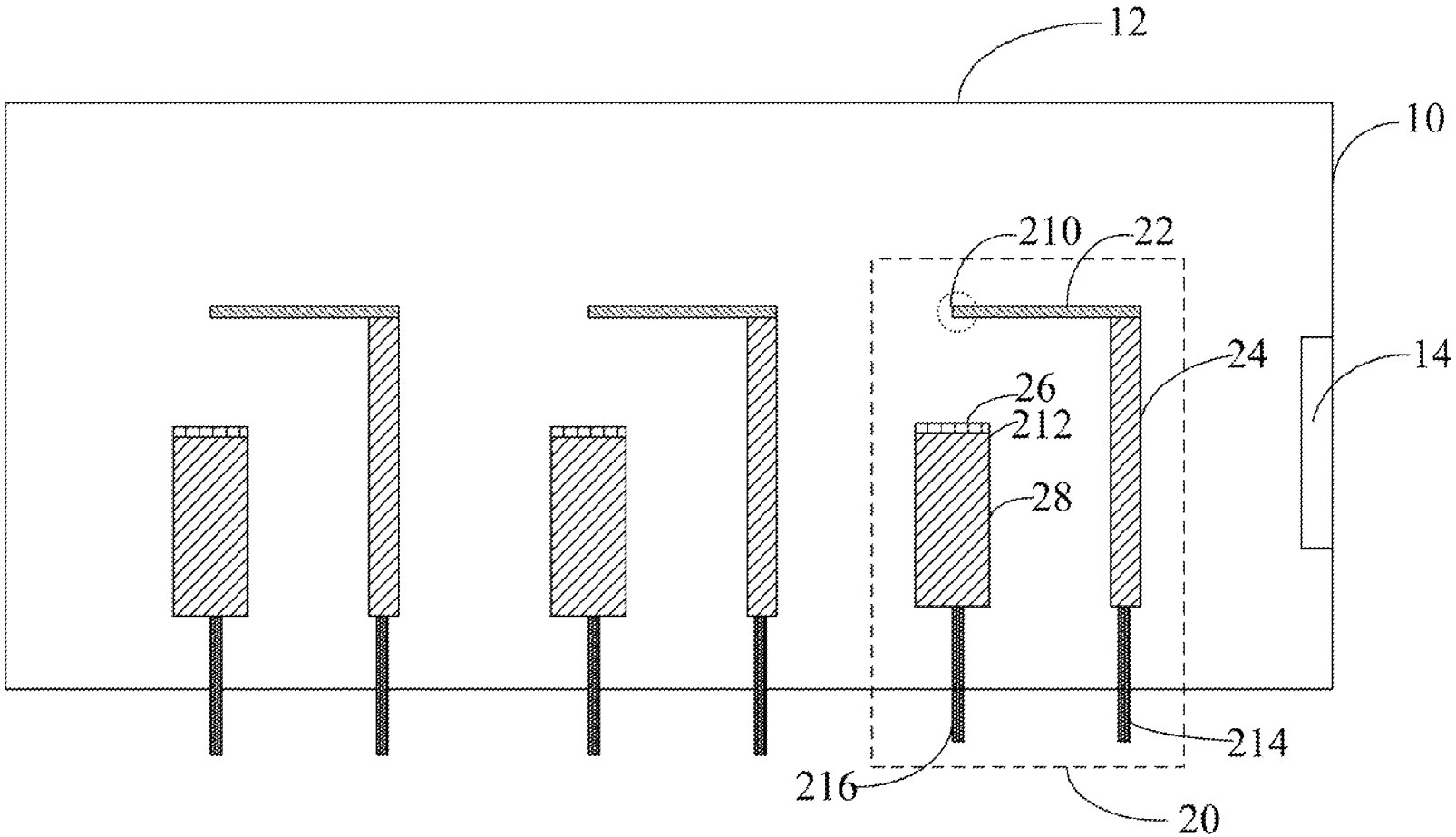
FIG. 2 is a schematic, cross-sectional view of a color FED according to an embodiment.

Referring to FIGS. 1 and 2, a color FED 100 includes a sealed container 10 having a light permeable portion 12, and at least one color element 20 enclosed in the sealed container 10. The sealed container 10 is a hollow member that defines an inner space in vacuum. The cross section of the sealed container 10 has a shape selected from a group consisting of circular, ellipsoid, quadrangular, triangular, polygonal and so on. The sealed container 10 may be comprised of any non-metallic material, and the emission portion 12 need be made of a transparent material. In the present embodiment, the sealed container 10 is a hollow cylinder and comprised of quartz or glass. A diameter of the sealed container 10 is about 2-10 millimeters (mm), and a height thereof is about 5-50 mm. The light permeable portion 12 has a surface selected from the group consisting of a plane surface, a spherical surface and an aspherical surface. Due to at least one color element 20 being sealed into one sealed container 10, the method for manufacturing the color FED 100 is simple and convenient, and the luminescence efficiency thereof is improved.

Each color element 20 includes a cathode 24, three anodes 28, three phosphor layers 26 and three CNT strings 22. The distances between the cathode 24 and the anodes 28 are substantially equal, and are about 0.1-10 millimeters (mm) The spaces among the adjacent anodes 28 are beneficially equal. The cathode 24 is electrically connected to a cathode terminal 214, and each of the anodes 28 is electrically connected to a corresponding anode terminal 216. The cathode terminal 214, and the anode terminal 216 run from the inside to the outside of the sealed container 10, and are supplied with the power source. By adjusting the voltages applied to the anode terminals 216, the color FED 100 can emit any kinds of color light beam, such as white, yellow. The cathode 24, the anodes 28, the cathode terminal 214 and the anode terminals 216 are made of thermally and electrically conductive materials.

In each color element 20, the anodes 28, the phosphor layers 26 and the CNT strings 22 have the same structures, and thus the cathode 24, the anode 28, the phosphor layer 26 and the CNT string 22 are described in the following as an example. Referring to FIG. 2, the phosphor layer 26 with a thickness of about 5-50 microns (pm) is formed on a end surface 212 of the anode 28. The phosphor layer 26 may be a white phosphor layer, or a color phosphor layer, such as red, green or blue. The end surface 212 is a polished metal surface or a plated metal surface, and thus can reflect the light beams emitted from the phosphor layer 26 to the permeable portion 12 to enhance the brightness of the color FED 100.

The CNT string 22 is electrically connected to and in contact with the cathode 24 by a conductive paste, such as silver paste, with an emission portion 210 of the CNT string 22 suspending. The phosphor layer 26 is opposite to the light permeable portion 12, and the emission portion 210 is corresponding to the phosphor layer 26. A distance between the emission portion 210 and the phosphor layer 26 is less than 5 mm. The emission portion 210 can be arranged perpendicular to the phosphor layer 26, parallel to phosphor layer 26 or inclined to phosphor layer 26 with a certain angle. In the present embodiment, the emission portion 210 is parallel to phosphor layer 26, and arranged between the phosphor layer 26 and the light permeable portion 12. The cathode 24 is made of an electrically conductive material, such as nickel, copper, tungsten, gold, molybdenum or platinum.

The CNT string 22 is composed of a number of closely packed CNT bundles, and each of the CNT bundles includes a number of CNTs, which are substantially parallel to each other and are joined by van der Waals attractive force. A diameter of the CNT string 22 is in an approximate range from 1 to 100 microns (μm), and a length thereof is in an approximate range from 0.1-10 centimeters (cm).

Figure 3:
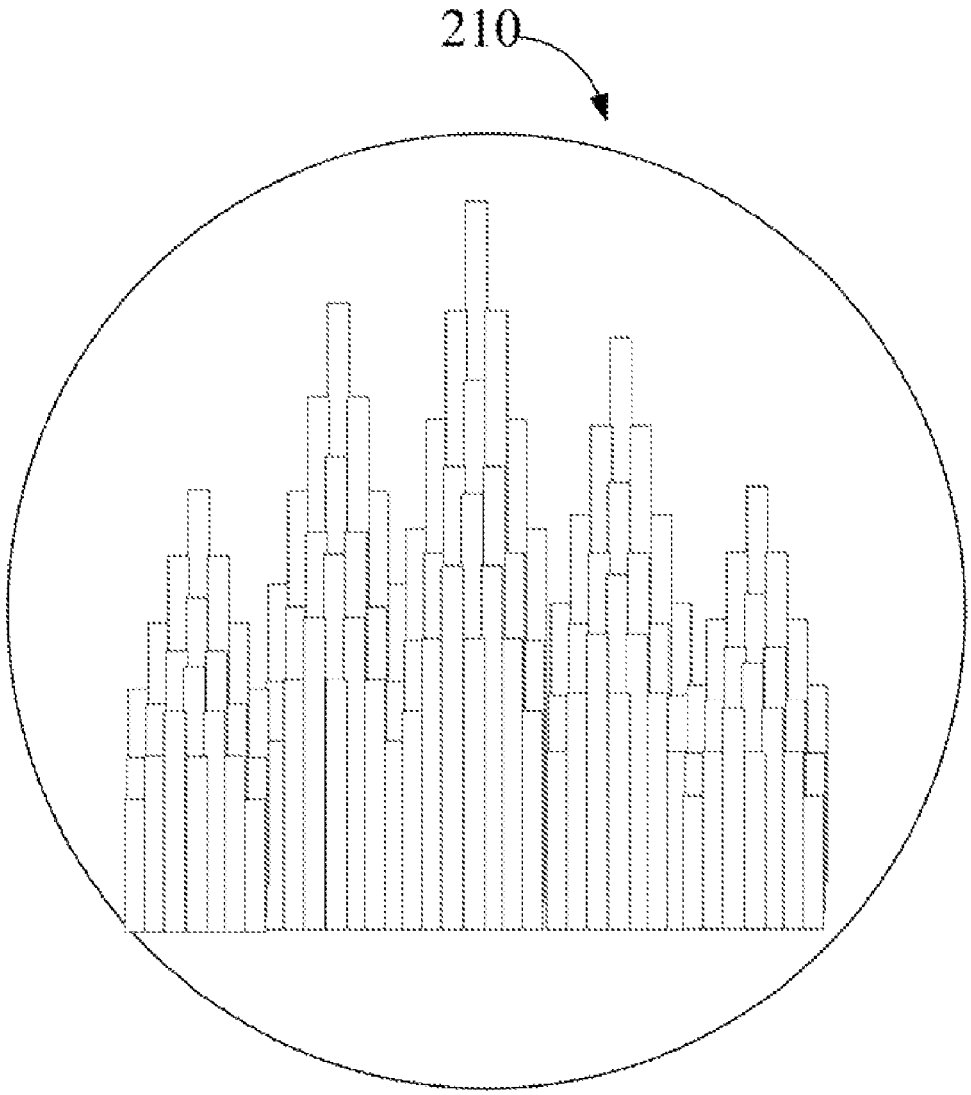
FIG. 3 is a schematic, amplificatory view of part 210 in FIG. 2.
Figure 4:
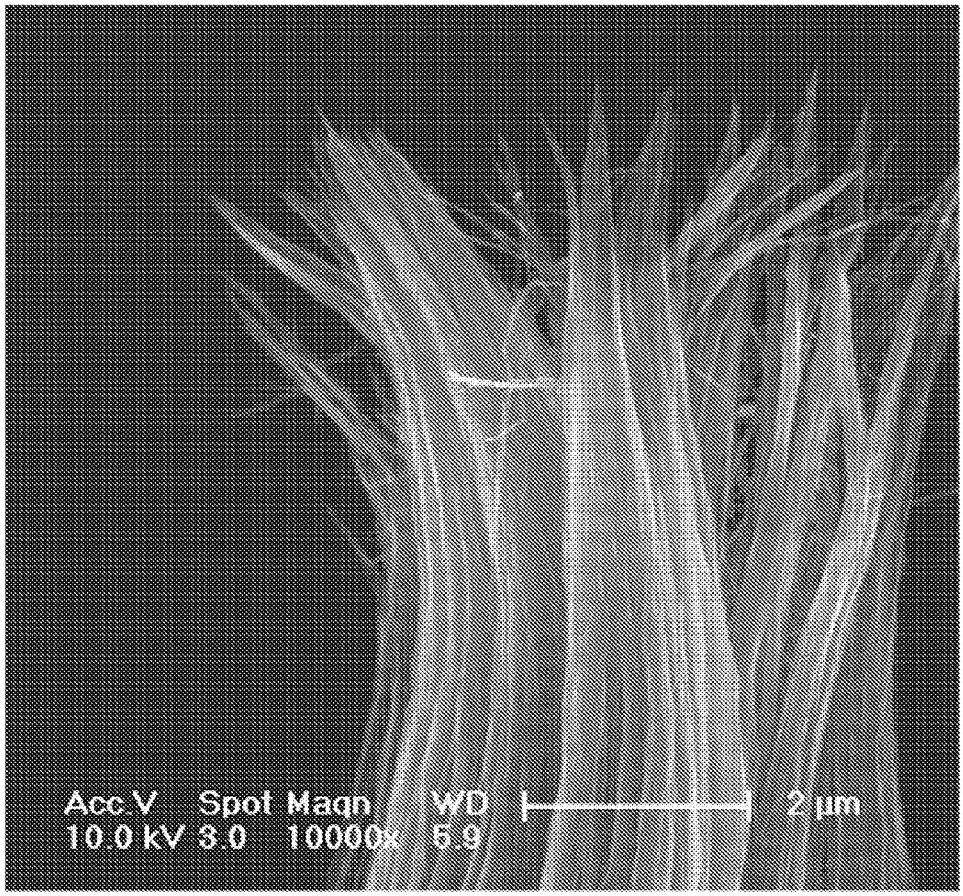
FIG. 4 is a Scanning Electron Microscope (SEM) image, showing part 210 in FIG. 2.
Figure 5:
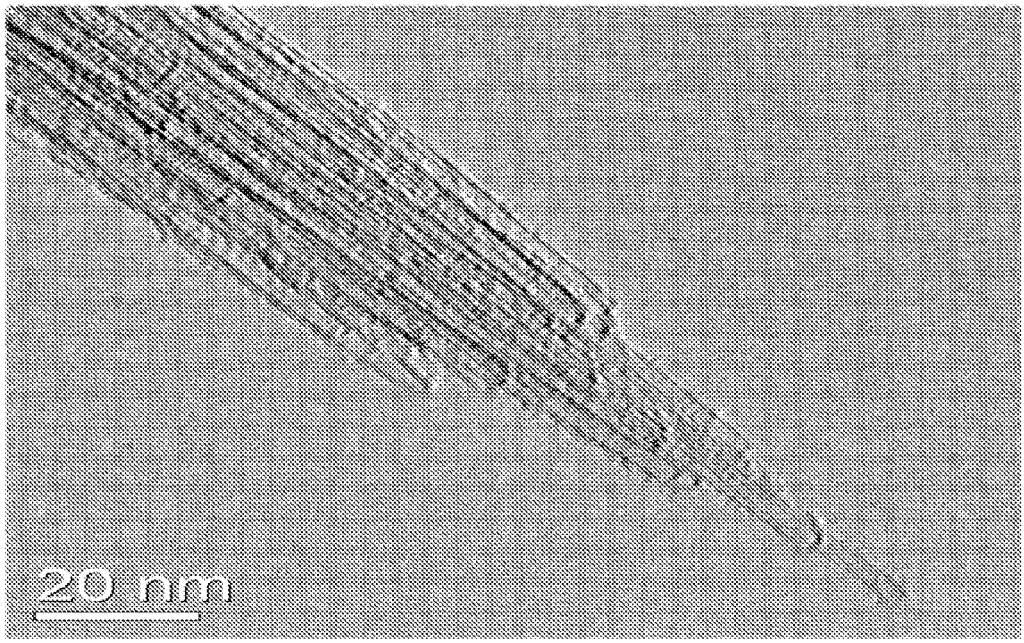
FIG. 5 is a Transmission Electron Microscope (TEM) image, showing part 210 in FIG. 2.

Referring to FIGS. 3, 4 and 5, the CNTs at the emission portion 210 form a tooth-shaped structure, i.e., some of CNT bundles being taller than and projecting above the adjacent CNT bundles. Therefore, a shield effect caused by the adjacent CNTs can be reduced. The voltage applied to the CNT string 22 for emitting electrons is reduced. The CNTs at the emission portion 210 have smaller diameter and fewer number of graphite layer, typically, less than 5 nanometer (nm) in diameter and about 2-3 in wall. However, the CNTs in the CNT string 22 other than the emission portion 210 are about 15 nm in diameter and more than 5 in wall.

A method for making the CNT string 22 is taught in U.S. Application No. US16663 entitled "METHOD FOR MANUFACTURING FIELD EMISSION ELECTRON SOURCE HAVING CARBON NANOTUBES", which is incorporated herein by reference. The CNT string 22 can be drawing a bundle of CNTs from a super-aligned CNT array to be held together by van der Waals force interactions. Then, the CNT string 22 is soaked in an ethanol solvent, and thermally treated by supplying a current thereto. After the above processes, the CNT string 22 has improved electrical conducting and mechanical strength.

In operation, a voltage is applied between the cathode 24 and the anode 28 through the cathode terminal 214 and the anode terminal 216, an electric field is formed therebetween, and electrons are emanated from the emission portion 210 of the CNT string 22. The electrons transmit toward the anode 28, hit the phosphor layer 26, and the visible light beams are emitted from the phosphor layer 26. One part of the light beams transmits through the light permeable portion 12, another part is reflected by the end surface 212 and then transmits out of the light permeable portion 12. Using the CNT string 22, the luminance of the color FED 100 is enhanced at a relatively low voltage.

The color FED 100 may further includes a getter 14 configured for absorbing residual gas inside the sealed container 10 and maintaining the vacuum in the inner space of the sealed container 10. More preferably, the getter 14 is arranged on an inner surface of the sealed container 10. The getter 14 may be an evaporable getter introduced using high frequency heating. The getter 14 also can be a non-evaporable getter.

The color FED 100 may further includes an air vent (not shown). The air vent can be connected with a gas removal system such as, for example, a vacuum pump for creating a vacuum inside the sealed container. The color FED 100 is evacuated to obtain the vacuum by the gas removal system through the air vent, and then sealed.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A color field emission display comprising:

a sealed container comprising a light permeable portion;

a color element enclosed in the sealed container, and comprising:

a cathode;

an anode spaced from the cathode;

a phosphor layer formed on an end surface of the anode; and a carbon nanotube string having a first end electrically connected to the cathode and an opposite second end functioning as an emission portion, wherein the second end comprises a plurality of tapered carbon nanotube bundles.

2. The color field emission display of claim 1, wherein each of the plurality of tapered carbon nanotube bundles comprises a plurality of carbon nanotubes substantially parallel to each other and joined by van der Waals attractive force.

3. The color field emission display of claim 2, wherein a single carbon nanotube of the plurality of carbon nanotubes is taller than and projects over other carbon nanotubes.

4. The color field emission display of claim 3, wherein the single carbon nanotube is located in the middle of the other carbon nanotubes.

5. The color field emission display of claim 2, wherein a diameter of each of the plurality of carbon nanotubes is less than 5 nanometers, and a number of graphite layers of each of the plurality of carbon nanotubes is about 2 to 3.

6. The color field emission display of claim 1, wherein a diameter of the carbon nanotube string is in an approximate range from 1 micrometer to 100 micrometers, and a length of the carbon nanotube string is in an approximate range from 0.1 centimeters to 10 centimeters.

7. The color field emission display of claim 1, wherein the carbon nanotube string comprises a plurality of closely packed carbon nanotube bundles joined end by end.

8. The color field emission display of claim 1, wherein the carbon nanotube string is in contact with the cathode via a conductive paste.

9. The color field emission display of claim 1, wherein the phosphor layer has a luminescence surface, and the emission portion is arranged perpendicularly to the luminescence surface, or inclined to the luminescence surface at a certain angle.

10. The color field emission display of claim 1, wherein the anode and the cathode each have a post configuration and are parallel to each other.

11. The color field emission display of claim 1, wherein the end surface of the anode is a polished metal surface.

12. The color field emission display of claim 1, wherein a plurality of color elements is enclosed in the sealed container, and each of the plurality of color elements comprises:

a single cathode;

at least two anodes spaced from the single cathode;

at least two phosphor layers, wherein each of the at least two phosphor layers is formed on an end surface of one of the at least two anodes; and at least two carbon nanotube strings electrically connected to the single cathode, wherein each of the at least two carbon nanotube strings extends from the single cathode to one of the at least two phosphor layers.

13. A color field emission display comprising:

a sealed container comprising a light permeable portion;

a color element enclosed in the sealed container, and comprising:

a cathode;

an anode spaced from the cathode;

a phosphor layer formed on an end surface of the anode; and a carbon nanotube string having a first end electrically connected to the cathode and an opposite second end functioning as an emission portion, wherein the second end comprises a plurality of carbon nanotube peaks spaced from each other and functioning as electron emitters.

14. The color field emission display of claim 13, wherein each of the plurality of carbon nanotube peaks comprises a plurality of carbon nanotubes substantially parallel to each other and joined by van der Waals attractive force.

15. The color field emission display of claim 14, wherein a height of the plurality of carbon nanotubes becomes taller from outermost carbon nanotubes to middle carbon nanotubes.

16. The color field emission display of claim 15, wherein each of the plurality of carbon nanotube peaks has a single carbon nanotube taller than and projecting over adjacent carbon nanotubes.

17. The color field emission display of claim 13, wherein the carbon nanotube string comprises a plurality of closely packed carbon nanotube bundles joined end by end.

18. A color field emission display comprising:

a sealed container comprising a light permeable portion;

a color element enclosed in the sealed container, and comprising:

a cathode;

an anode spaced from the cathode;

a phosphor layer formed on an end surface of the anode; and a carbon nanotube string having a first end electrically connected to the cathode and an opposite second end functioning as an emission portion, wherein the second end comprises a plurality of carbon nanotube bundles forming a tooth-shaped structure.

19. The color field emission display of claim 18, wherein the second end comprises a plurality of first carbon nanotube bundles and a plurality of second carbon nanotube bundles; the plurality of first carbon nanotube bundles is taller than and projects above the plurality of second carbon nanotube bundles.

20. The color field emission display of claim 19, wherein each of the plurality of first carbon nanotube bundles comprises a plurality of carbon nanotubes substantially parallel to each other and joined by van der Waals attractive force; a single carbon nanotube of the plurality of carbon nanotubes is taller than and projects over adjacent carbon nanotubes.

* * * * *